US010276093B2

(12) United States Patent
Lee et al.

(10) Patent No.: US 10,276,093 B2
(45) Date of Patent: Apr. 30, 2019

(54) ORGANIC LIGHT EMITTING DIODE DISPLAY DEVICE USING VERTICAL SYNCHRONIZATION SIGNALS WITH DIFFERENT PHASE

(71) Applicant: LG Display Co., Ltd., Seoul (KR)

(72) Inventors: Geun-Woo Lee, Seoul (KR); An-Su Kim, Yongin-si (KR)

(73) Assignee: LG DISPLAY CO., LTD., Seoul (KR)

( * ) Notice: Subject to any disclaimer, the term of this patent is extended or adjusted under 35 U.S.C. 154(b) by 148 days.

(21) Appl. No.: 15/336,513

(22) Filed: Oct. 27, 2016

(65) Prior Publication Data

US 2017/0124949 A1 May 4, 2017

(30) Foreign Application Priority Data

Oct. 30, 2015 (KR) ..... 10-2015-0152383

(51) Int. Cl.

*G09G 3/3233* (2016.01)
*G09G 5/00* (2006.01)
*G09G 3/20* (2006.01)

(52) U.S. Cl.

CPC ..... *G09G 3/3233* (2013.01); *G09G 5/006* (2013.01); *G09G 5/008* (2013.01); *G09G 3/2096* (2013.01);

(Continued)

(58) Field of Classification Search

CPC ..... G09G 2310/08; G09G 2320/029; G09G 2320/0295; G09G 2320/045;

(Continued)

(56) References Cited

U.S. PATENT DOCUMENTS 6,564,269 B1 5/2003 Martin
6,989,827 B2 * 1/2006 Myers ..... G09G 5/006 345/204

(Continued)

FOREIGN PATENT DOCUMENTS

CN 202841323 U 3/2013
CN 103050083 A 4/2013

(Continued)

OTHER PUBLICATIONS

Lemme, "OLEDs—Senkrechtstarter aus Kunststoff Beste Aussichten fur Displays aus organischen Leuchtdioden," Elektronik, W E K A Fachzeitschriften-Verlag GMBH, DE, vol. 49, No. 2, Feb. 2000 (Jan. 25, 2000), pp. 97-103, XP000945626.

*Primary Examiner* — Ram A Mistry
(74) *Attorney, Agent, or Firm* — Birch, Stewart, Kolasch & Birch, LLP

(57) ABSTRACT

An organic light emitting diode (OLED) display device is discussed. The OLED display device includes a display module including a display panel and a panel driver for driving the display panel, and a host system externally separated from the display module. The OLED display device further includes an interface device including a transmission module configured to transmit sensing data via a plurality of vertical synchronization signals for communication between the host system and the display module. The transmission module generates first and second vertical synchronization signals having blank periods that are not overlapping with each other. The interface device transmits the sensing data in a sensing period of one vertical synchronization signal that overlaps with the blank period of another vertical synchronization signal.

20 Claims, 5 Drawing Sheets

(52) U.S. Cl.
CPC ... *G09G 2310/08* (2013.01); *G09G 2320/029* (2013.01); *G09G 2320/0295* (2013.01); *G09G 2320/045* (2013.01); *G09G 2340/06* (2013.01); *G09G 2370/00* (2013.01); *G09G 2370/08* (2013.01)

(58) Field of Classification Search
CPC ..... G09G 2340/06; G09G 2370/00; G09G 2370/08; G09G 3/2096; G09G 3/3233; G09G 5/006; G09G 5/008
See application file for complete search history.

(56) References Cited

U.S. PATENT DOCUMENTS

| | | | | |
|---|---|---|---|---|
| 2009/0213048 | A1* | 8/2009 | Park | G09G 3/2003 345/77 |
| 2011/0128287 | A1* | 6/2011 | Lee | H04N 13/398 345/426 |
| 2013/0147693 | A1* | 6/2013 | Bae | G09G 3/3208 345/82 |

FOREIGN PATENT DOCUMENTS

| | | | |
|---|---|---|---|
| CN | 103680392 | A | 3/2014 |
| JP | 2006-350341 | A | 12/2006 |
| JP | 2007-43659 | A | 2/2007 |
| JP | 2007-322501 | A | 12/2007 |
| JP | 2012-128424 | A | 7/2012 |

* cited by examiner

ORGANIC LIGHT EMITTING DIODE DISPLAY DEVICE USING VERTICAL SYNCHRONIZATION SIGNALS WITH DIFFERENT PHASE

This application claims priority from and the benefit under 35 U.S.C. § 119(a) of Korean Patent Application No. 10-2015-0152383, filed on Oct. 30, 2015, which is hereby incorporated by reference for all purposes as if fully set forth herein.

BACKGROUND OF THE INVENTION

Field of the Invention

The present invention relates to a display device including an interface device capable of effectively transmitting sensing data for external compensation while using an encrypted transmission technology during communication between a display module and a control module externally separated from the display module for slimness of the display module.

Discussion of the Related Art

As the information technology has advanced, the market of display devices as mediums connecting users and information has grown. In line with this, the use of display devices such as liquid crystal displays (LCDs), organic light emitting display devices, electrophoretic displays (EPDs), and plasma display panels (PDPs) has increased.

Representative examples of flat display devices recently highlighted as display devices to display an image, using digital data, include a liquid crystal display (LCD) using liquid crystals, an organic light emitting diode (OLED) display using OLEDs, and the like.

An organic light emitting diode (OLED) display device is a self-luminous device in which an organic light emitting layer emits light through re-combination of electrons and holes. Since the OLED display device exhibits high luminance, and uses a low drive voltage while achieving slimness, the OLED display device is expected to be a next-generation display device.

Such an OLED display device includes a plurality of pixels, each of which includes an OLED constituted by an anode, a cathode, and an organic light emitting layer interposed between the anode and the cathode, and a pixel circuit for independently driving the OLED. The pixel circuit includes a switching thin film transistor (TFT) for supplying a data voltage to a storage capacitor, a drive TFT for controlling drive current in accordance with a drive voltage charged in the storage capacitor, and supplying the controlled drive current to the OLED, and so on. The OLED generates light having a light amount proportional to the amount of the drive current.

In OLED display devices according to the related art, however, non-uniformity of luminance may occur because there may be deviations of driving characteristics (threshold voltage and mobility) of drive TFTs among pixels due to process deviation and with passage of time. In order to solve such a problem, OLED display devices use an external compensation method for sensing driving characteristics of each pixel, and compensating data to be supplied to the pixel, using the sensed value.

OLED display devices are applicable to various products such as portable terminals, TV sets, flexible displays, transparent displays, and so on. Recent advances in OLED display devices are focused on slimness, for application of such OLED display devices to a paper display or a wallpaper display.

For slimness of a display module in an OLED display device, a scheme to externally separate a part of circuit configurations mounted in the display module should be taken into consideration. In this case, an encrypted transmission system is required in order to protect content during communication between the display module and the separated circuit configuration. In particular, when an interface using the encrypted transmission system is used, problems associated with transmission of sensing data required for external compensation of the OLED display device should also be taken into consideration.

SUMMARY OF THE INVENTION

Accordingly, the present invention is directed to an organic light emitting diode (OLED) display device that substantially obviates one or more problems due to limitations and disadvantages of the related art.

An object of the present invention is to provide an organic light emitting diode display device capable of externally separating a control module from a display module, thereby achieving slimness of the display module.

Another object of the present invention is to provide an OLED display device including an interface device capable of efficiently transmitting sensing data while using an encrypted transmission protocol for communication between a display module and a control module externally separated from the display module.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an organic light emitting diode (OLED) display device includes a display module comprising a display panel, and a panel driver for driving the display panel, a host system separated from the display module, the host system comprising a timing controller for controlling the panel driver, and an interface device for performing communication between the host system and the display module.

In the interface device of the OLED display device according to the illustrated embodiment of the present invention, it may be possible to efficiently transmit sensing data in an alternating manner through a plurality of channels respectively using a plurality of vertical synchronization signals respectively processed to have non-overlapping blank periods, such that transmission of the sensing data is carried out in an active period of one channel overlapping with a blank period of another channel.

In an aspect of the present invention, there is provided an OLED display device including a display module, a host system, and an interface. The display module includes a display panel and a panel driver for driving the display panel. The host system is externally separated from the display module to achieve slimness of the display module. The interface device includes a transmission module configured to transmit sensing data via a plurality of vertical synchronization signals for communication between the host system and the display module. The transmission module generates first and second vertical synchronization signals having blank periods that are not overlapping with each other. The interface device transmits the sensing data in a sensing period of one vertical synchronization signal that overlaps with the blank period of another vertical synchronization signal.

In another aspect of the present invention, there is provided a method for operating an organic light emitting diode (OLED) display device including a display module, a host system externally separated from the display module, and an interface device including a transmission module configured to transmit sensing data via a plurality of vertical synchronization signals for communication between the host system and the display module. The method includes generating, via the transmission module, first and second vertical synchronization signals having blank periods that are not overlapping with each other, and transmitting, via the interface device, sensing data using an encrypted transmission protocol in a sensing period of one vertical synchronization signal that overlaps with the blank period of another vertical synchronization signal. The method further includes transmitting 3-color RGB data, via a first channel, in an active period of the first vertical synchronization signal and transmitting 1-color W data, via a second channel, in an active period of the second vertical synchronization signal.

Accordingly, the OLED display device according to the illustrated embodiment of the present invention may not only externally separate the control module from the display module, but also may efficiently transmit sensing data for external compensation in spite of use of an encrypted transmission protocol for protection of externally exposed content, using the above-described interface device. Thus, slimness of the display module may be achieved and, as such, the OLED display device may be applied to a wallpaper display or the like.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and along with the description serve to explain the principle of the invention. In the drawings.

DETAILED DESCRIPTION OF THE EMBODIMENTS

Reference will now be made in detail to the preferred embodiments of the present invention, examples of which are illustrated in the accompanying drawings.

Figure 1:
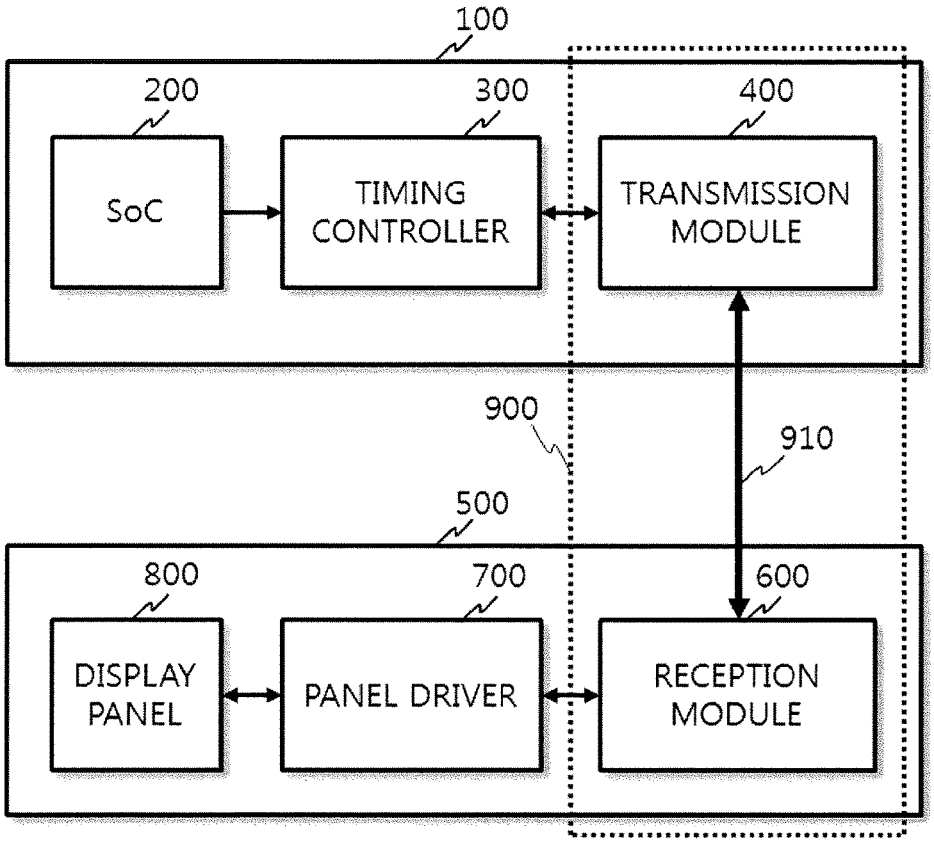
FIG. 1 is a block diagram schematically illustrating a configuration of an organic light emitting diode (OLED) display device according to an embodiment of the present invention.

FIG. 1 is a block diagram illustrating a configuration of an organic light emitting diode (OLED) display device according to an embodiment of the present invention.

Referring to FIG. 1, the OLED device includes a host system 100 and a display module 500.

The display module 500 includes a reception module 600, a panel driver 700, and a display panel 800. The host system 100 includes a system-on-chip (SoC) 200, a timing controller 300, and a transmission module 400.

For slimness of the display module 500, a control printed circuit board including the timing controller 300 is separated from the display module 500, and is built in the host system 100.

For protection of content during communication between the display module 500 and the timing controller 300 externally separated from the display module 500, an interface device 900 using an encrypted transmission system is applied to the OLED display device. In accordance with an embodiment of the present invention, the interface device 900 includes the transmission module of the host system 100, and the reception module 600 of the display module 500 connected to the transmission module 400 via a cable 910. The transmission module 400 and reception module 600 may be referred to as a "SerDes Tx IC" having an integrated circuit structure and a "SerDes Rx IC" having an integrated circuit structure, respectively.

The host system 100 may be any one of systems of portable terminals, for example, a computer, a TV system, a set-top box, a tablet, and a portable phone.

The SoC 200 includes a scaler or the like, to convert video data into data having a resolution format suitable for display on the display module 500, and then to output the converted data to the timing controller 300. The SoC 200 generates a plurality of timing signals including a clock CLK, a data enable signal DE, a vertical synchronization signal Vsync, a horizontal synchronization signal Hsync, etc.

The SoC 200 and timing controller 300 may communicate with each other, using any one of various interfaces. For example, the SoC 200 and timing controller 300 may transmit and receive data and clocks by use of a low voltage differential signaling (LVDS) interface. In this case, the SoC 200 includes an LVDS transmitter installed at an output stage of the SoC 200, whereas the timing controller 300 includes an LVDS transmitter installed at an input stage of the timing controller 300.

The timing controller 300 converts data of 3 colors (red, green, and blue (RGB)) received from the SoC 200 into data of 4 colors (white, red, green, and blue (WRGB)), using a predetermined RGB-to-WRGB conversion method. The timing controller 300 processes the WRGB data through various image processing procedures such as power consumption reduction, picture quality compensation, external compensation, and degradation compensation, and then outputs the resultant data.

For example, for power consumption reduction, the timing controller 300 analyzes an input image, to determine a peak luminance of the input image in accordance with information as to image characteristics such as average picture level (APL), and adjusts a gamma high-level voltage EVDD in accordance with the determined peak luminance.

The adjusted gamma high-level voltage EVDD is then supplied to the display module 500 through the interface device 900.

For external compensation for deviations among pixels, the timing controller 300 senses driving characteristics (threshold voltage Vth and mobility of drive TFT, Vth of OLED, etc.) of each pixel in the display panel 800 through the interface device 900 and panel driver 700 in every desired sensing period such as a power-on time, a vertical blank period of each vertical synchronization signal, or a power-off time.

For example, in each sensing period, the timing controller 300 supplies sensing data (data included in video data) to pixels corresponding to the sensing period through the interface device 900 and panel driver 700, to drive the pixels. The panel driver 700 senses, as a voltage, pixel current reflecting driving characteristics of each driven pixel, and converts the sensed value into a digital sensing value. The digital sensing value from the panel driver 700 is supplied to the timing controller 300 through the interface device 900.

The timing controller 300 processes the sensing value of each pixel, generates compensation values for compensating for driving deviations of pixels (mobility and Vth deviations of drive TFTs, Vth deviations of OLEDs, etc.), and stores the generated compensation values in a memory. The timing controller 300 compensates pixel data to be supplied to the pixels, using the compensation values stored in the memory, and then outputs the compensated pixel data.

The timing controller 300 generates data control signals and gate control signals for controlling driving timing of the panel driver 700, using timing signals received from the SoC 200, and outputs the generated control signals to the panel driver 700 through the interface device 900. The data control signals may include a source start pulse, a source sampling clock and a source output enable signal for controlling driving timing of a data driver. The gate control signals may include a gate start pulse, a gate shift clock and a gate output enable signal for controlling driving timing of a gate driver. The timing controller 300 may transmit the vertical synchronization signal Vsync to the transmission module 400, together with the above-described control signals.

The interface device 900 uses a high definition multimedia interface (HDMI) supporting an encryption algorithm for high-bandwidth digital content protection (HDCP) capable of preventing copy of content, in order to protect externally exposed content. The HDMI uses a transition minimized differential signaling (TMDS) communication scheme, which is a digital transmission protocol.

The transmission module 400 encrypts pixel data received from the timing controller 300, using the HDCP encryption algorithm, and then converts the encrypted pixel data into a transmission packet, together with control information and so on. A differential signal corresponding to the transmission packet is transmitted from the transmission module 400 to the reception module 600 in a series manner via the cable 910. The reception module 600 recovers the transmission packet from the received differential signal, and recovers the pixel data, control information, etc., using an HDCP recovery algorithm. The recovered data is then output from the reception module 600 to the panel driver 700.

Figure 2A:
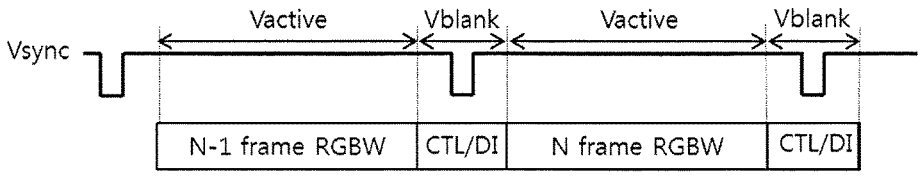
FIG. 2A (RELATED ART)
FIGS. 2A and 2B are diagrams illustrating comparison of a data transmission sequence of an interface device according to an embodiment of the present invention (FIG. 2B) with that of an interface device of the related art (FIG. 2A)
Figure 2B:
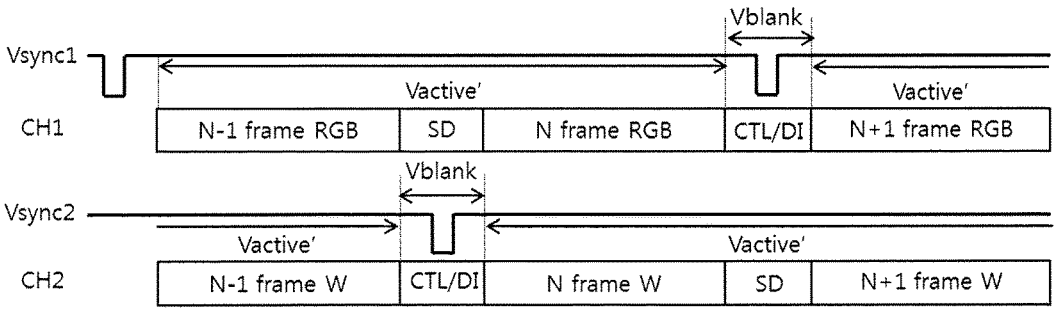

FIGS. 2A and 2B are diagrams illustrating comparison of a data transmission sequence of an interface device according to an embodiment of the present invention (FIG. 2B) with that of an interface device of the related art (FIG. 2A).

In the transition minimized differential signaling (TMDS) communication scheme, as illustrated in FIG. 2A (related art), it is necessary to transmit RGBW data during an active period Vactive while transmitting various control data CTL and data island DI signals (audio signals or the like) during a blank period Vblank, using the vertical synchronization signal Vsync. For this reason, there is a problem in the related art OLED display devices that it is impossible to transmit sensing data for external compensation in the blank period Vblank.

In order to solve or address this problem, as illustrated in FIG. 2B, the transmission module 400 uses vertical synchronization signals Vsync1 and Vsync2 each having a reduced frequency corresponding to ½ of the frequency of the input vertical synchronization signal (having a period increased two times) such that each of the vertical synchronization signals Vsync1 and Vsync2 includes an active period Vactive' including pixel data transmission periods for two frames, and a sensing period SD allocated between the pixel data transmission periods. In this case, the sensing period SD of one channel overlaps with the blank period Vblank of another channel.

Accordingly, it may be possible to transmit sensing data, using the sensing period included in the active period of each vertical synchronization signal. In particular, it may be possible to transmit the sensing data by alternating the sensing periods of two channels, namely, first and second channels CH1 and CH2 according to an embodiment of the present invention.

The transmission module 400 may increase the transmission rate of RGBW data without frequency increase by transmitting RGB data and W data to the reception module 600 in a separated manner in respective active periods Vactive' of the corresponding vertical synchronization signals Vsync1 and Vsync2, through the first and second channels CH1 and CH2, which use different vertical synchronization signals, namely, the first and second vertical synchronization signals Vsync1 and Vsync2, respectively. The transmission module 400 may also transmit additional information CTL/DL including control information CTL and so on in the blank period Vblank.

The transmission module 400 time-divides the active period Vactive' of the first vertical synchronization signal Vsync1 corresponding to the first channel CH1, and transmits RGB data of N−1-th and N-th frames in the time-divided active periods, respectively. The transmission module 400 also time-divides the active period Vactive' of the second vertical synchronization signal Vsync2 corresponding to the second channel CH2, and transmits W data of the N−1-th and N-th frames in the time-divided active periods, respectively. The transmission module 400 transmits sensing data in the sensing period SD between the N−1-th and N-th frames corresponding to the first channel CH1, and transmits additional data CTL/DI in the blank period Vblank between the N−1-th and N-th frames corresponding to the second channel CH2.

Thus, the transmission module 400 may efficiently transmit sensing data to the reception module 600 in the sensing period included in the active period in accordance with frequency and phase adjustment of the vertical synchronization signals. In addition, although each vertical synchronization signal has a frequency reduced by ½, transmission of pixel data and additional information may be achieved without frequency change.

The timing controller 300 and transmission module 400 transmit and receive data, using any one of various interfaces. The reception module 600 and panel driver 700 also transmit and receive data, using any one of various interfaces.

For example, an LVDS interface, an embedded point-to-point interface (EPI) known as a high speed serial interface, or a V-by-one (Vx1) interface may be used. For application of the EPI or Vx1 interface, the transmitter installed at the output stage of the timing controller 300 or the output stage of the reception module 600 converts pixel data and control information including various control data into a transmission packet having a serial format while including clocks. The transmitter then transmits the transmission packet in the form of a differential signal through a pair of transmission lines. The receiver installed at the input stage of the transmission module 400 or the input stage of the data driver included in the panel driver 700 recovers clocks, control information and pixel data from the transmission packet received thereby. The transmission packet includes a control packet including a clock training pattern for clock locking of the receiver, an alignment training pattern, clocks, and control information in the form of serial data, and a data packet including clocks and pixel data in the form of serial data.

Figure 3:
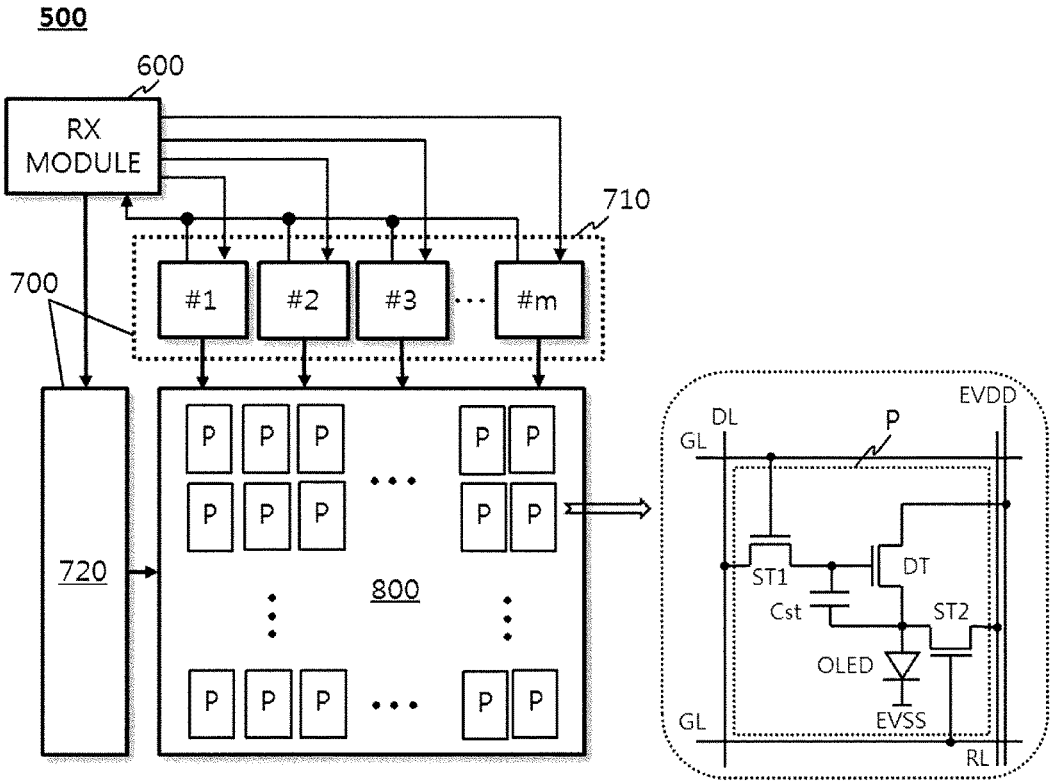
FIG. 3 is a diagram illustrating a configuration of a display module illustrated in FIG. 1.

FIG. 3 is a block diagram briefly illustrating a configuration of the display module 500 illustrated in FIG. 1.

Referring to FIG. 3, the display module 500 includes a panel driving unit 700 including the reception (RX) module 600, a data driver 710, and a gate driver 720, and the display panel 800.

The reception module 600 performs data processing required for the differential signal transmitted from the transmission module 400 via the cable 910, thereby recovering pixel data and control information, as described above. The reception module 600 converts pixel data and data control information into an EPI packet, and transmits the EPI packet to a plurality of data ICs #1 to #m constituting the data driver 710. The reception module 600 transmits a gate control signal to the gate driver 720. The gate control signal may be supplied to the gate driver 720 after being level-shifted while passing through a level shifter included in a power IC.

Each of the data ICs #1 to #m constituting the data driver 710 recovers clocks, control information, and pixel data from the EPI packet transmitted from the reception module 600, converts the pixel data into an analog data signal, and then supplies the analog data signal to corresponding ones of data lines DL included in the display panel 800. Each of the data ICs #1 to #m sub-divides a set of reference gamma voltages supplied from a gamma voltage generator separately provided at the outside into grayscale voltages respectively corresponding to grayscale values of pixel data. Each of the data ICs #1 to #m is driven in accordance with a data control signal, and converts digital data into an analog data signal, using the sub-divided grayscale voltages, and supplies the analog data signal to the corresponding data lines DL of the display panel 800. Each of the data ICs #1 to #m converts sensing pixel data supplied through the reception module 600 in each sensing period into an analog data signal, and supplies the analog data signal to the corresponding pixel P, and senses a voltage according to pixel current reflecting driving characteristics of the corresponding pixel P. Each of the data ICs #1 to #m converts the sensed voltage into a digital sensing value, and supplies a differential signal corresponding to the digital sensing value to the timing controller 300 via the interface device 900 as shown in FIG. 1.

Each of the data ICs #1 to #m may be mounted on a circuit film such as a tape carrier package (TCP), a chip-on-film (COF), a flexible printed circuit (FPC) or the like, and may then be attached to the display panel 800 in a tape automated bonding (TAB) manner or may be mounted on the display panel 800 in a chip-on-glass (COG) manner.

The gate driver 720 drives a plurality of gate lines GL included in the display panel 800 in response to gate control signals supplied from the reception module 600. In response to the gate control signals, the gate driver 720 supplies a scan pulse corresponding to a gate-on voltage to each gate line in a scan period corresponding to the gate line, and supplies a gate-off voltage to the gate line in the remaining periods. The gate driver 720 may be constituted by at least one gate IC. In this case, the gate driver 720 may be mounted on a circuit film such as a TCP, a COF, or an FPC, and may then be attached to the display panel 800 in a TAB manner or may be mounted on the display panel 800 in a COG manner. Otherwise, the gate driver 720 may be formed at a TFT substrate, together with a TFT array constituting a pixel array and, as such, may be installed at a non-display area of the display panel 800 in the form of a gate-in-panel (GIP) type.

The display panel 800 displays an image through a pixel array in which pixels P are arranged in a matrix form. The pixel array is constituted by W/R/G/B pixels.

Each pixel P includes an OLED connected between a high-level voltage source (EVDD) line and a low-level voltage source (EVSS) line, and a pixel circuit for independently driving the OLED. The pixel circuit includes a first switching TFT ST1, a second switching TFT ST2, a drive TFT DT, and a storage capacitor Cst. The configuration of the pixel circuit may be diverse and, as such, is not limited to the configuration of FIG. 3.

The OLED includes an anode connected to the drive TFT DT, a cathode connected to the EVSS line, and a light emitting layer arranged between the anode and the cathode. In accordance with this configuration, the OLED generates light in an amount proportional to the amount of current supplied from the drive TFT DT.

The first switching TFT ST1 is driven by a gate signal supplied from one gate line GL, and supplies a data signal from a corresponding one of the data lines DL to a gate node of the drive TFT DT. On the other hand, the second switching TFT ST2 is driven by a gate signal supplied from another gate line GL, and supplies a reference voltage from a reference line RL to a source node of the drive TFT DT. The second switching TFT ST2 is also used as a path for outputting current from the drive TFT DT to the reference line RL in a sensing period.

The storage capacitor Cst, which is connected between the gate and source nodes of the drive TFTs DT, is charged with a differential voltage between the data voltage supplied to the gate node through the first switching TFT ST1 and the reference voltage supplied to the source node through the second switching TFT ST2, and supplies the differential voltage as a drive voltage of the drive TFT DT.

The drive TFT DT controls current supplied from the high-level voltage source EVDD in accordance with the drive voltage supplied from the storage capacitor Cst and, as such, supplies current proportional to the drive voltage to the OLED which, in turn, emits light.

Figure 4:
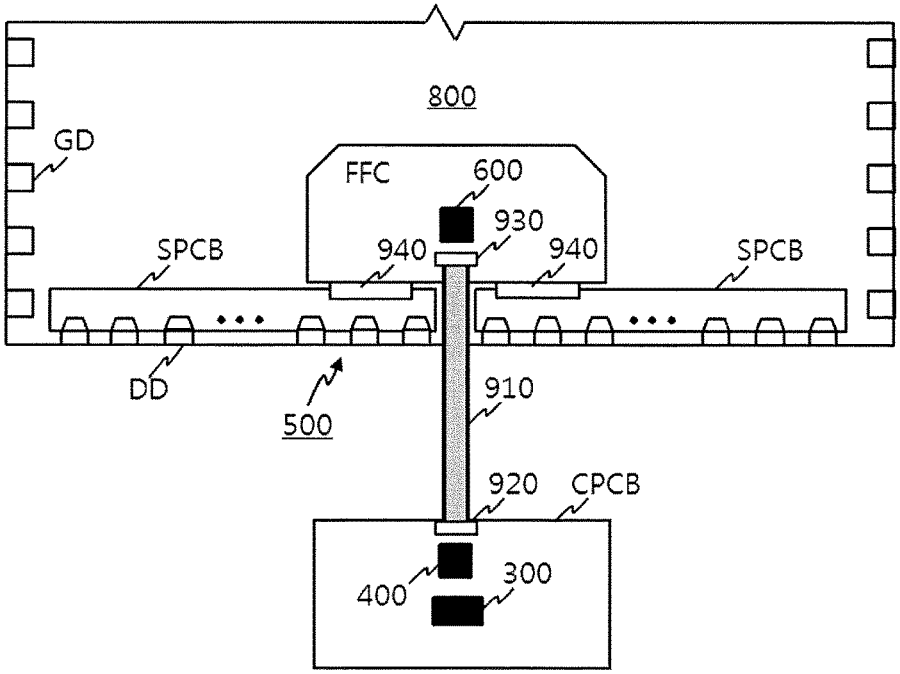
FIG. 4 is a diagram illustrating a slim configuration of the OLED display device according to an embodiment of the present invention.

FIG. 4 is a view illustrating a structure of the OLED display device, which achieves slimness in accordance with an embodiment of the present invention.

Referring to FIG. 4, the control printed circuit board (CPCB), on which the timing controller 300 is mounted, is externally separated from the display module 500, and is connected to a flat flexible cable (FFC) included in the display module 500 by the cable 910. The CPCB is built in the above-described host system. The above-described system-on-chip (SoC) may also be mounted on the CPCB. The power IC, etc. may further be mounted on the FFC of the display module 500.

For content protection, the above-described transmission module 400, namely, a SerDes Tx IC, is mounted on the CPCB, and the above-described reception module 600, namely, a SerDes Rx IC, is mounted on the FFC. The transmission module 400 and reception module 600 communicate with each other through the cable 910 connected between a connector 920 of the CPCB and a connector 930 of the FFC in accordance with an HDMI transmission protocol.

The data drivers DD to drive the data lines of the display panel 800 are connected to the display panel 800. The data drivers DD are connected to a plurality of source printed circuit boards (SPCBs) in a divided manner. Each data driver DD may be constituted by a COF, on which a data IC is mounted. The SPCBs are connected to the FFC via a connector 940.

The gate drivers GD are connected to opposite lateral sides of the display panel 800, to drive the gate lines at the opposite sides of the display panel 800. Each gate driver GD may be constituted by a COF, on which a gate IC is mounted.

Thus, in the OLED display device according to the embodiment of the present invention, slimness of the display module 500 is achieved in accordance with external separation of the CPCB and, as such, the OLED display device may be applied to a wallpaper display or the like.

Figure 5:
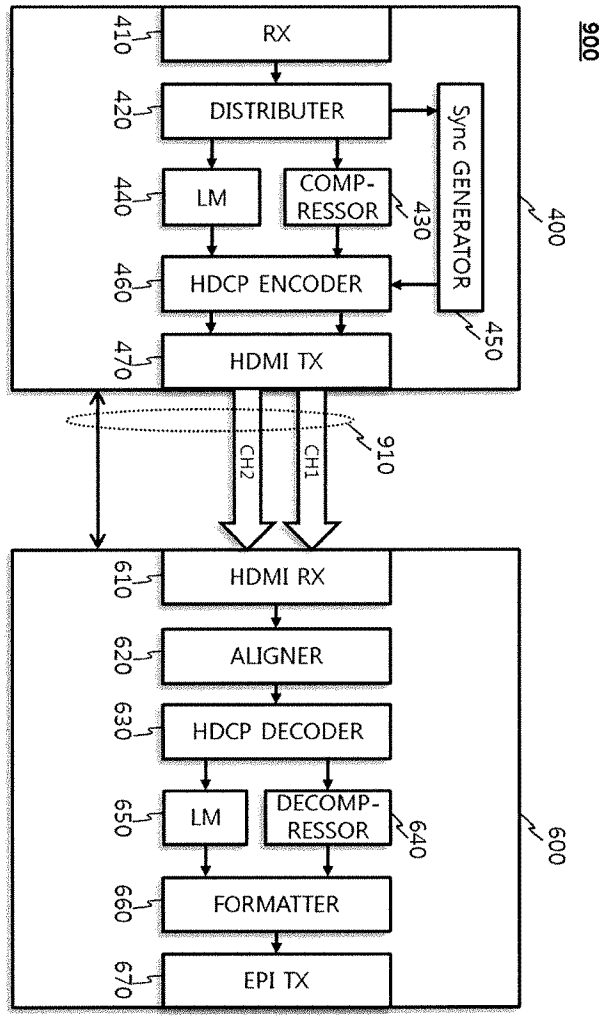
FIG. 5 is a block diagram illustrating an internal configuration of the interface device according to an embodiment of the present invention.

FIG. 5 is a block diagram illustrating a configuration of the interface device 900 according to an embodiment of the present invention.

Referring to FIG. 5, the transmission module 400 includes a receiver (RX) 410, a distributer 420, a compressor 430, a line memory (LM) 440, a synchronization signal (sync) generator 450, an HDCP encoder 460, and an HDMI transmitter (TX) 470.

The receiver 410 recovers clocks, pixel data and control information from an EPI or Vx1 transmission packet corresponding to a differential signal transmitted from the timing controller 300, and outputs the recovered data.

The distributer 420 separates reception data supplied from the receiver 410 into RGB data, W data, and control information, and outputs the separated data.

The compressor 430 compresses the RGB data supplied from the distributer 420, and outputs the compressed data. The line memory 440 delays the W data supplied from the distributer 420 for a period in which the RGB data is compressed and, as such, outputs the W data without compression. The RGB data is compressed by the compressor 430, to reduce the number of bits to be transmitted and, as such, the number of transmission lines may be reduced.

The synchronization signal generator 450 generates first and second vertical synchronization signals Vsync1 and Vsync2 (cf. FIG. 2B) having a reduced frequency corresponding to ½ of the frequency of an input vertical synchronization signal included in the control information supplied from the distributer 420, as described above, while having different phases, using the input vertical synchronization signal, and outputs the generated first and second vertical synchronization signals Vsync1 and Vsync2.

The HDCP encoder 460 encrypts the compressed RGB data supplied from the compressor 430, and outputs the encrypted data to the first channel CH1 via the HDMI TX 470. The HDCP encoder 460 also encrypts the non-compressed W data supplied from the line memory LM 440, and outputs the encrypted data to the second channel CH2 via the HDMI TX 470. The HDMI TX 470 transmits RGB data in an active period of the first vertical synchronization signal Vsync1 through the first channel CH1 in the form of a differential signal while transmitting control information in a blank period of the first vertical synchronization signal Vsync1 in the form of a differential signal. On the other hand. The HDMI TX 470 transmits W data in an active period of the second vertical synchronization signal Vsync2 through the second channel CH2 in the form of a differential signal while transmitting the control information in a blank period of the second vertical synchronization signal Vsync2 in the form of a differential signal. As described above, the HDMI TX 470 transmits sensing data supplied from the HDCP encoder 460 via the first and second channels CH1 and CH2 in sensing periods corresponding to the first and second channels CH1 and CH2, respectively.

The reception module 600 includes an HDMI receiver (RX) 610, an aligner 620, an HDCP decoder 630, a decompressor 640, a line memory LM 650, a formatter 660, and an EPI transmitter 670.

The HDMI receiver 610 performs signal processing on differential signals respectively supplied from the HDMI transmitter 470 via the first and second channels CH1 and CH2, thereby recovering clocks, transmission data, and control information. The recovered data is then aligned by the aligner 620, and is then transmitted to the HDCP decoder 630.

The HDCP decoder 630 recovers RGB data and W data from data output from the aligner 620, and outputs the recovered data.

The decompressor 640 decompresses the compressed RGB data supplied from the HDCP decoder 630, and outputs the decompressed data. The line memory 650 outputs the W data supplied from the HDCP decoder 630 after delaying the W data.

The formatter 660 converts RGBW data supplied from the decompressor 640 and line memory 650, namely, pixel data and control information, into an EPI transmission packet, together with clocks, and transmits the converted data in the form of a differential signal to each data driver DD via the EPI TX 670.

The cable 910 connected between the transmission module 400 and the reception module 600 further includes an additional link. A sensing value supplied from the data driver 710 in the form of a differential signal is transmitted to the timing controller 300 via the interface device 900.

As apparent from the above description, in accordance with the interface device and method in the display device according to the embodiments of the present invention, it may be possible to efficiently transmit sensing data in an alternating manner through a plurality of channels respectively using a plurality of vertical synchronization signals respectively processed to have non-overlapping blank periods, such that transmission of the sensing data is carried out in an active period of one channel overlapping with a blank period of another channel.

Accordingly, the OLED display device according to the embodiments of the present invention may not only externally separate the control module from the display module, but also may efficiently transmit sensing data for external compensation in spite of use of an encrypted transmission protocol for protection of externally exposed content, using the above-described interface device. Thus, slimness of the display module may be achieved and, as such, the OLED display device may be applied to a wallpaper display or the like.

It will be apparent to those skilled in the art that various modifications and variations can be made in the present invention without departing from the spirit or scope of the inventions. Thus, it is intended that the present invention cover the modifications and variations of this invention provided they come within the scope of the appended claims and their equivalents.

What is claimed is:

1. An organic light emitting diode (OLED) display device comprising:

a display module including a display panel and a panel driver for driving the display panel;

a host system externally separated from the display module; and an interface device including a transmission module configured to transmit sensing data via a plurality of vertical synchronization signals for communication between the host system and the display module, wherein the transmission module generates first and second vertical synchronization signals having blank periods that are not overlapping with each other, wherein the interface device transmits the sensing data in a sensing period of one vertical synchronization signal that overlaps with the blank period of another vertical synchronization signal, and wherein the first and second vertical synchronization signals each has a phase different from the other.

2. The OLED display device of claim 1, wherein the interface device includes a reception module of the display module, the transmission module embedded in the host system, and a cable connecting the transmission module and the reception module.

3. The OLED display device of claim 1, wherein the sensing period is included in an active period of the first and second vertical synchronization signals.

4. The OLED display device of claim 1, wherein the transmission module transmits 3-color RGB data through a first channel in an active period of one vertical synchronization signal, and transmits 1-color W data through a second channel in an active period of another vertical synchronization signal.

5. The OLED display device of claim 1, wherein the interface device transmits the sensing data using an encrypted transmission protocol.

6. The OLED display device of claim 4, wherein a sensing period of the first channel overlaps with a blank period of the second channel.

7. The OLED display device of claim 1, wherein the transmission module transmits control information in a blank period of one vertical synchronization signal which overlaps a sensing period of another vertical synchronization signal.

8. The OLED display device of claim 1, wherein an active period of the first and second vertical synchronization signals includes pixel data transmission periods for two frames and a sensing period allocated between the pixel data transmission periods.

9. The OLED display device of claim 4, wherein the active period of the first and second vertical synchronization signals alternately has a sensing period in which the sensing data is transmitted.

10. The OLED display device of claim 1, wherein the host system includes a computer, a TV set, a set-top box, a tablet, or a portable phone.

11. An organic light emitting diode (OLED) display device comprising:

a display module including a panel driver for driving a display panel;

a control module externally separated from the display module; and an interface device including a transmission module configured to transmit sensing data and image data via a plurality of vertical synchronization signals for communication between the control module and the display module, wherein the transmission module generates first and second vertical synchronization signals having blank periods that are not overlapping with each other, wherein the interface device transmits the sensing data using an encrypted transmission protocol in a sensing period of one vertical synchronization signal that overlaps with the blank period of another vertical synchronization signal, and wherein the first and second vertical synchronization signals each has a phase different from the other.

12. The OLED display device of claim 11, wherein the interface device includes a reception module of the display module, the transmission module embedded in the control module, and a cable connecting the transmission module and the reception module.

13. The OLED display device of claim 11, wherein an active period of one vertical synchronization signal includes pixel data transmission periods for two frames and the sensing period allocated between the pixel data transmission periods.

14. The OLED display device of claim 11, wherein the transmission module transmits 3-color RGB data through a first channel in an active period of the first vertical synchronization signal, and transmits 1-color W data through a second channel in an active period of the second vertical synchronization signal.

15. The OLED display device of claim 11, wherein the interface device transmits the sensing data in the sensing period included in an active period of one vertical synchronization signal that overlaps with the blank period of another vertical synchronization signal.

16. The OLED display device of claim 11, wherein the transmission module transmits control information in the blank period of one vertical synchronization signal which overlaps the sensing period of another vertical synchronization signal.

17. The OLED display device of claim 14, wherein the transmission modules transmits the sensing data by alternating the sensing periods of the first and second channels.

18. The OLED display device of claim 14, wherein a sensing period of one channel overlaps with a blank period of another channel.

19. The OLED display device of claim 11, wherein the control module includes a computer, a TV set, a set-top box, a tablet, or a portable phone.

20. A method of operating an organic light emitting diode (OLED) display device including a display module, a host system externally separated from the display module, and an interface device including a transmission module configured to transmit sensing data via a plurality of vertical synchronization signals for communication between the host system and the display module, the method comprising:

generating, via the transmission module, first and second vertical synchronization signals having blank periods that are not overlapping with each other;

transmitting, via the interface device, sensing data using an encrypted transmission protocol in a sensing period of one vertical synchronization signal that overlaps with the blank period of another vertical synchronization signal;

compressing 3-color RGB data among 4-color RGBW data;

transmitting the compressed 3-color RGB data, via a first channel, in an active period of the first vertical synchronization signal; and transmitting non-compressed 1-color W data, via a second channel, in an active period of the second vertical synchronization signal, wherein the first and second vertical synchronization signals each has a phase different from the other.

* * * * *